US005860753A

United States Patent [19]

Beck et al.

[11] Patent Number: 5,860,753

[45] Date of Patent: Jan. 19, 1999

[54] MECHANISM FOR CENTERING ROLLS OF PAPER STOCK SUPPLIED FOR PRINTING

[75] Inventors: David F. Beck, Exeter; Roy P. Lyman, Warwick; Frank B. Macedo, Greenwich, all of R.I.

[73] Assignee: Comtec Information Systems, Inc., Warwick, R.I.

[21] Appl. No.: 992,856

[22] Filed: Dec. 18, 1997

[51] Int. Cl.[6] ..... B41J 29/02

[52] U.S. Cl. ..... 400/692; 400/88; 242/563.1

[58] Field of Search ..... 400/88, 613, 613.1, 400/691, 692, 693, 693.1; 101/288; 242/554.1, 555.1, 563, 563.1, 566

[56] References Cited

U.S. PATENT DOCUMENTS

| | | | |
|---|---|---|---|
| 3,987,974 | 10/1976 | Mayer | 242/35.5 A |
| 4,556,422 | 12/1985 | Torbeck . | |
| 4,833,985 | 5/1989 | Kojima et al. | 101/401.1 |
| 5,092,688 | 3/1992 | Haennelt et al. | 400/88 |
| 5,267,800 | 12/1993 | Petteruti et al. . | |
| 5,447,379 | 9/1995 | Pou . | |
| 5,505,406 | 4/1996 | Summey, III | 242/563.1 |

*Primary Examiner*—Ren Yan
*Attorney, Agent, or Firm*—K. J. LuKacher; M. LuKacher

[57] ABSTRACT

An improved mechanism for centering a roll of paper stock for printing in a portable printer is provided, in which the printer has a housing with a cavity and an opening from a side thereof to provide a receptacle for the roll. The centering mechanism includes a spindle disposed in the cavity toward the opening and mounted in the housing for rotation about an axis, and a pair of arms coupled to each other to move in opposite directions with respect to a center between the arms. The arms engage the two opposing ends of the roll when received on the spindle for centering the roll on the spindle. The arms are coupled to each other by a rack and pinion assembly which moves the arms in opposite direction to each other responsive to a force applied by an operator to one of the arms when a roll is received on the spindle.

19 Claims, 4 Drawing Sheets

MECHANISM FOR CENTERING ROLLS OF PAPER STOCK SUPPLIED FOR PRINTING

DESCRIPTION

1. Field of the Invention

The present invention relates to a mechanism for centering rolls of paper stock on a spindle which is especially useful in a portable printer, and particularly to, a mechanism for automatically centering rolls of paper stock in different widths. The mechanism provided by the invention is especially adapted for use in a portable label printer which is carried by an operator and may be hand held, and more especially such printers which are loaded from a side of the housing of the printer.

2. Background of the Invention

Conventional portable label printers generally use a roll of wound stock material, such as paper, which is loaded into the printer such that paper from the roll will properly feed and be aligned with a print head for printing by the print head. It is usually desired to provide in such printers a facility for using rolls having different width paper, such that labels of different widths may be printed. The widths may range between one and several inches.

To accommodate the range of roll widths, the print head is of a length sufficient to print along the widest width paper. With a roll loaded into the printer, the print head is yieldably biased by springs against a platen over which the paper is fed. Printing quality may be reduced if the bias varies across the width of the paper. Thus, maintaining uniform bias on the print head over the entire width is desirable. If the paper is not aligned on the platen, the edge of the paper may be presented to the print head causing it to tilt and distort the uniformity of the bias. To resolve this problem in a portable label printer, the roll should be centered in the printer along its width with respect to the print head, such that the bias will be even over the paper from the roll regardless of the paper's width.

Typically, centering a roll in a printer has utilized a top-loading scheme in which the roll is located in a printer cavity and two rotatable spindle members are urged by spring or springs into the tubular core of the roll to move the roll into a center position. It is often difficult to load the roll using this scheme, since an operator must physically separate the two spindle members from each other while simultaneously orienting the core of the roll such that each member will fit into the core when released. If the roll's core is not properly oriented between the two members, the roll will not be properly aligned when the members collapse together under the spring force. Misalignment of the roll can also cause the printer to malfunction in feeding paper from the roll and in printing on the paper. Further, due to the compactness of the printer, the printer cavity is small which can cause difficulty for the operator to insert his or her fingers to drop and maneuver the roll in the cavity. This centering scheme is used, for example, in label printers manufactured by Eltron International of Simi Valley, Calif., of model no. P2242. Side loading of rolls into printers has been shown in U.S. Pat. Nos. 5,267,800 and 5,447,379. However, centering of rolls of different widths has required manipulation and is not as operator friendly as desirable.

In addition, the top-loading scheme limits the size of the roll, i.e., the amount of paper stock wound on the roll, due to the narrow dimensions of the top opening through which the roll is received into the printer's cavity. Thus, depending on the amount of printer use, rolls frequently need to be replaced with new rolls, which can make the printer more costly to operate. A further drawback is that the roll is generally not sufficiently secured in the printer and can easily misalign due to jarring of the printer.

SUMMARY OF THE INVENTION

Accordingly, it is the principal object of the present invention to provide an improved mechanism which automatically centers a roll of paper stock on a spindle, thereby facilitating loading of rolls of different widths for printing in a printer.

It is another object of the present invention to provide an improved mechanism for centering a roll of paper stock in a portable printer in which the roll is side-loaded into the housing of the printer.

It is yet another object of the present invention to provide an improved mechanism for centering a roll in a portable printer which can reliably center rolls having different width paper and can easily be loaded by an operator.

Briefly described, the present invention includes a mechanism for centering a roll of stock in a portable printer which prints upon the stock from the roll. The roll may be a paper stock of adhesive back labels wound upon a tubular core, or other media wound on a roll. A housing of the printer has a cavity, and an opening from a side thereof to provide a receptacle for the roll. The centering mechanism includes a spindle disposed in the cavity toward the opening and mounted in the housing for rotation about an axis, and a pair of arms coupled to each other to move in opposite directions with respect to a center between the arms. The arms engage the two opposing ends of the roll when received on the spindle for centering the roll on the spindle about the center. The arms are coupled to each other by a rack and pinion assembly of the centering mechanism which moves the arms in opposite directions to each other.

One of the arms is provided by a first guide (the inner edge guide) facing one end of the roll. The other arm is provided by a projecting member and a second guide (the outer edge guide) which faces the other end of the roll and may lie adjacent to the projecting member. The rack and pinion assembly includes a first rack member coupled to the first guide to be moveable therewith, and a second rack member coupled to the projecting member to be moveable therewith. A pinion is engagable with the first and second rack members to move the first and second rack members in opposite directions to each other. The pinion can rotate about a fixed position in the housing which determines the center between the first and second guides of the arms.

To center a roll, an operator pushes the second guide onto the spindle after a roll is placed on the spindle. In response, the second guide applies a force against the roll as it is received on the spindle, thereby moving the roll along the spindle. This force moves the first and second rack members in opposite directions to each other by the force being conveyed against the first guide, via said roll, or the projecting member, via the second guide, until both the second guide lies adjacent the projecting member, and the first guide lies adjacent the roll.

BRIEF DESCRIPTION OF THE DRAWINGS

The foregoing objects, features and advantages of the invention will become more apparent from a reading of the following description in connection with the accompanying drawings in which.

DETAILED DESCRIPTION OF THE INVENTION

Figure 2:
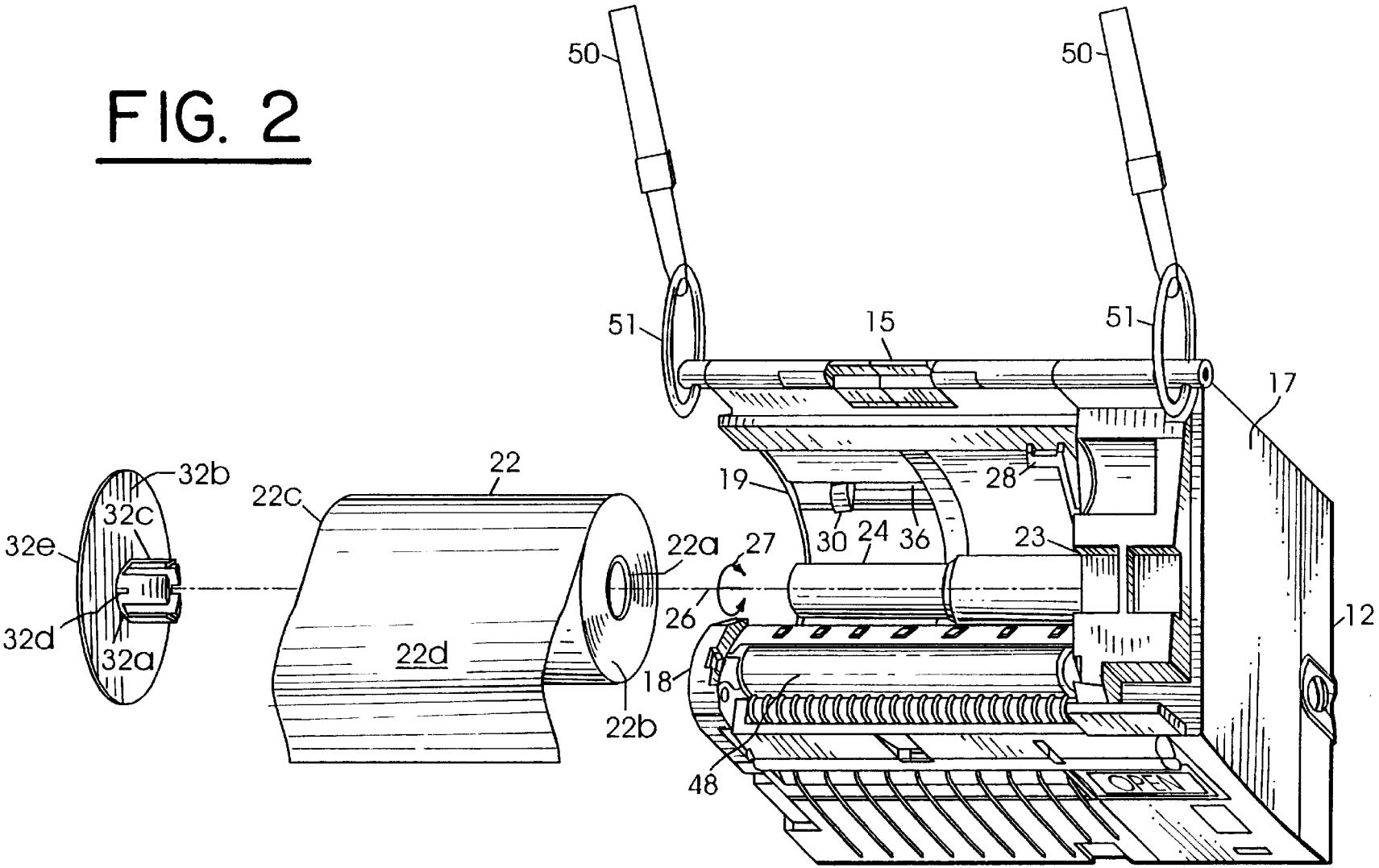
FIG. 2 is a perspective exploded view of the printer of FIG. 1 from the top with the top cover broken away.
Figure 3:
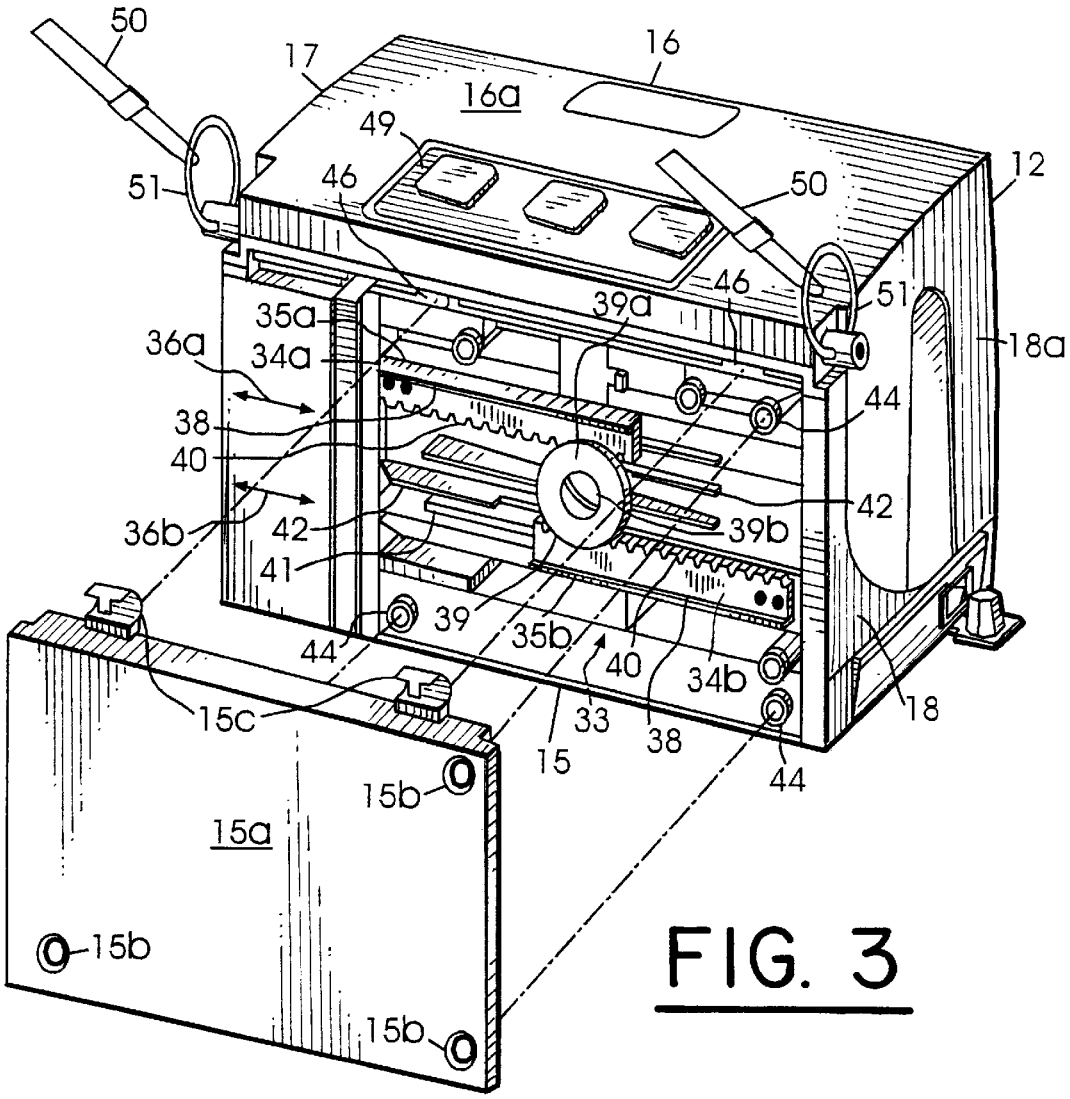
FIG. 3 is a perspective view of the printer of FIG. 1 from the rear showing the rack and pinion assembly of the centering mechanism.

Referring to the figures, a portable compact label printer 10 is shown having a housing 12 with a front portion 14, a rear portion 15, a top portion 16, and opposing sides portions 17 and 18. Side 18 has an opening 19 through which a roll 22 is mounted into a cavity 20 in housing 12. Roll 22 is a roll of stock material 22*d,* such as adhesive backed paper carried on a web which is wound on a tubular core 22*a,* or may be any other media. A cover 18*a* is hingedly connected to housing 12 such that it closes opening 19 in side 18, as shown in FIG. 3. Cover 18*a* is not shown in FIGS. 1, 2, and 4 for purposes of illustrating the invention.

A mechanism is provided in housing 12 for automatically centering roll 22 as it is loaded from side 18 into cavity 20. The centering mechanism includes a spindle 24 in cavity 20 which is mounted on a shaft (not shown) protruding about half the length of housing 12 toward opening 19 from a side wall 23 of cavity 20. Spindle 24 has an internal bearing (not shown), which is coupled by a screw and washer to the end of this shaft, to allow spindle 24 to freely rotate along axis 26 as indicated by arrows 27. The shaft may have steps of decreasing diameters from side wall 23 toward opening 19 to prevent spindle 24 from cantilevering as it rotates. The internal bearing may be a self-lubricating plastic bearing mounted about halfway in spindle 24. The length of spindle 24 is longer than the widest possible width of roll 22, defined by the length of core 22*a* between opposing ends 22*b* and 22*c* of the roll.

In cavity 20, the centering mechanism further includes an inner edge guide 28, a projecting member 30, and an outside edge guide 32. Inner edge guide 28 has a flange 28*a* which extends into cavity 20 and faces end 22*b* of the roll when the roll is loaded via its core 22*a* onto spindle 24. Outer edge guide 32 has a hub 32*a* and a circular flange 32*b* which extends from hub 32*a*. Flexible fingers 32*c* extend from hub 32*a* generally perpendicular to the surface of flange 32*b* and have raised areas or tabs 32*d* (FIG. 2). Hub 32*a* is slidable along spindle 24 with fingers 32*c* facing towards the side wall 23. With roll 22 on spindle 24, flange 32*b* faces end 22*c* of the roll. Flange 32*a* has an outer rim or end 32*e* which can adjacently lie against projecting member 30 when outer edge guide 32 slides along the spindle toward side wall 23. The projecting member 30 extends into cavity 20 so as not to interfere with the loading of roll 22 on spindle 24. Also, the circular diameter of flange 32*b* is larger than the diameter of roll 22, such that a section 30*d* of projection member 30 will engage rim 32*c* during centering of the roll on spindle 24. Cavity 20 may have an interior generally contoured to allow outer edge guide 32 to slide along a substantial length of the spindle 24 from opening 19.

Figure 1:
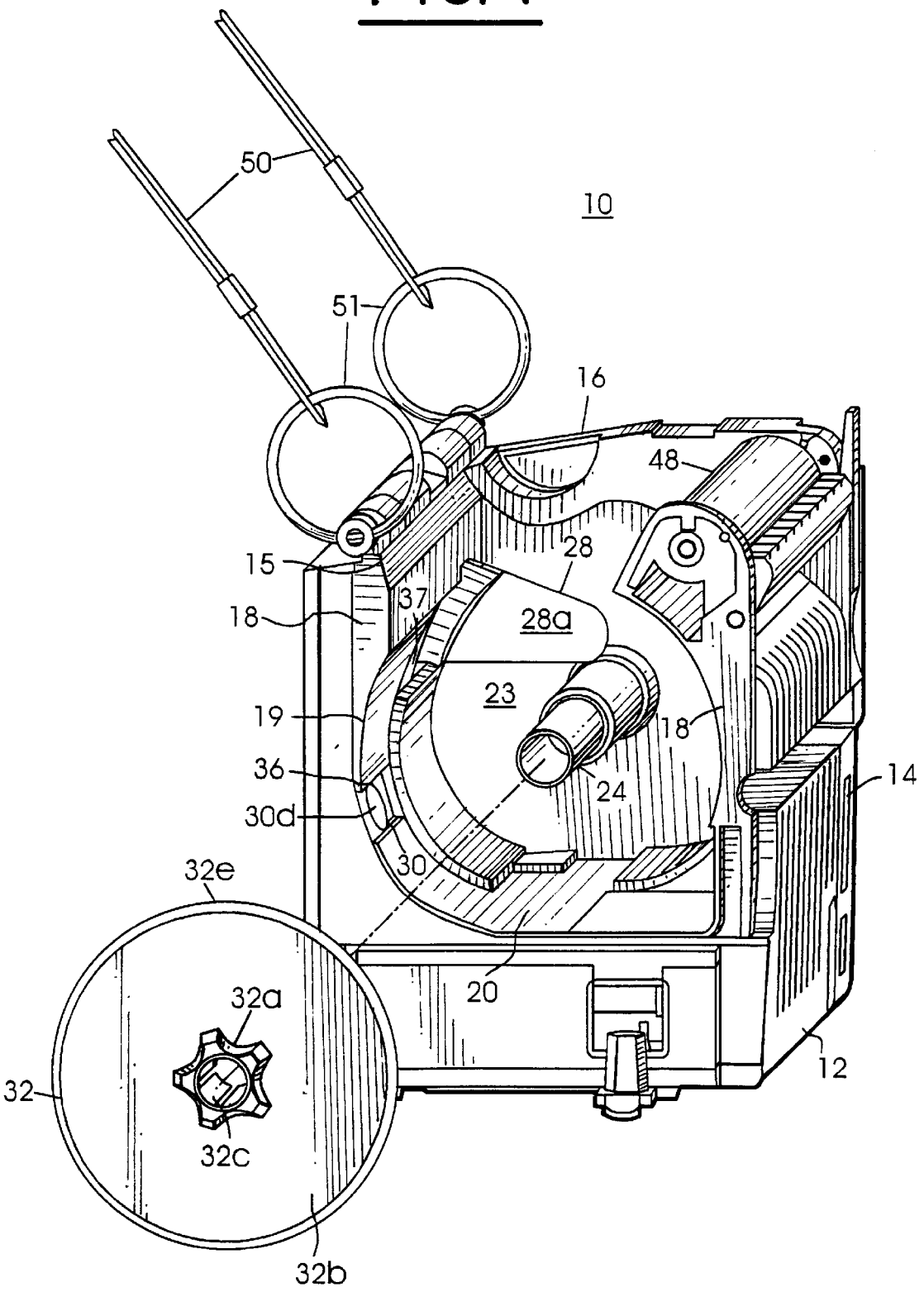
FIG. 1 is a perspective view from a side of a portable printer having a housing, the top cover of which is removed to shown the centering mechanism according to the present invention.
Figure 3A:
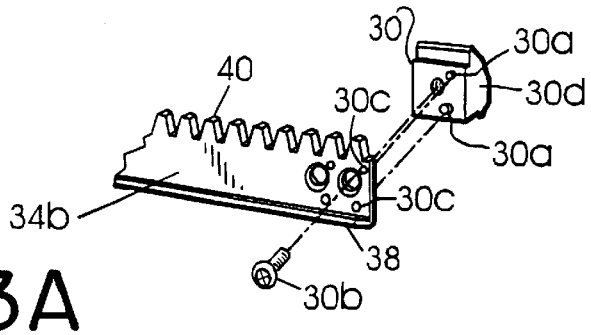
FIG. 3A is a perspective exploded view of part of the rack and pinion assembly shown in FIG. 3.

The centering mechanism has a rack and pinion assembly 33 which couples the inner edge guide 28 and projecting member 30 to each other, and enables them to move in opposite directions from each other approximately parallel to axis 26 of the spindle. The rack and pinion assembly 33 is shown in FIG. 3 with a rear cover 15*a* removed. Assembly 33 has upper and lower rack members 34*a* and 34*b* which are located in slots 35*a* and 35*b,* respectively. Rack members 34*a* and 34*b* each have an "L" or "T" shaped edge 38 which rides in slots 35*a* and 35*b,* respectively. Edge 38 is illustrated as "L" shaped in FIGS. 3 and 3A. Arrows 36*a* and 36*b* represent the linear motion of each rack member 34*a* and 34*b* in their respective slot, which is also approximately parallel with axis 26 of the spindle. At one end of rack 34*b,* projecting member 30 is attached through a window 36 (FIG. 1) in cavity 20 by a screw 30*b* threaded into member 30, as shown in FIG. 3A. Pins 30*a* are provided to assist in aligning projecting member 30 on rack member 34*b* via holes 30*c*. Inner edge guide 28 is similarly attached to the end of rack 34*a* through window 37 (FIG. 1). Other attachment means or additional screws maybe used to attach inner edge guide 28 and projecting member 30 to their respective rack members. Racks 34*a* and 34*b* each engage, via their teeth 40, opposite sides of a pinion 39, such that they move in opposite directions within their respective slots responsive to rotation of pinion 39.

Pinion 39 includes a circular flange 39*a* to retain rack members 34*a* and 34*b* in slots 35*a* and 35*b,* respectively, and a gear (not shown) having teeth which engage teeth 40 of rack members 34*a* and 34*b*. Preferably, flange 39*a* and this gear are part of a single molded assembly. Pinion 39 rotatably mounted to housing 12 by a screw 39*b* threaded into the housing which extends through a boss (or a washer) and the center of pinion 39. Screw 39*b* may be a tapered head or shoulder screw.

Ribs 41 may be provided in housing 12 under rack member 34*b* to provide a level path for motion in slot 35*b*. Similarly, ribs may be provided under rack member 34*a* to provide a level path for motion in slot 35*a*. Also, raised ribs 42 may be provided in housing 12 to provide a gap between rear cover 15*a* and the rack and pinion assembly 33 when the cover is closed. Cover 15*a* may be attached by screws, through holes 15*b,* and hinges 15*c* into aligned holes 44 and slots 46, respectively, in housing 12.

Projecting member 30, attached to rack member 34*b,* and inner edge guide 28, attached to rack member 34*a,* move in opposite direction to each other toward and away from a center position between them. The center position is determined by the mounted location of pinion 39 in the housing 12. The extent of the reciprocal opposite movement of inner edge guide 28 and projecting member 30 is determined by the size of windows 37 and 36, respectively, along the direction of such movement. In this manner, inner edge guide 28 represents one of a pair of arms of the centering mechanism, while outer edge guide 32 with the projecting member 30 represent the other of the pair of arms when the outer edge guide is slid onto spindle 24 against projecting member 30. The pair of arms is coupled to the rack and pinion assembly 33, and thus coupled to each other, to move in opposite directions with respect to the center between the arms. The arms engage the opposing ends 22*b* and 22*c* of roll 22 when the roll is received on the spindle 24 to center the roll about the center position determined by the location of pinion 39, as described in more detail below.

To center roll 22, an operator pushes the outer edge guide 32 onto spindle 24 while placing a roll on the spindle (or after placing a roll on the spindle), such that fingers 32*c* of hub 32*a* are oriented in the direction of side wall 23 and the fingers lie between the spindle and the inner surface of core 22*a* of the roll. In response to the external force of the operator on outer edge guide 32, the outer edge guide applies a force against the roll, thereby moving the roll along spindle 24. This force moves the first and second rack members 34*a* and 34*b* in opposite directions through rotation of pinion 39 by the force being conveyed either against the inner edge guide 28, via the roll, or projecting member 30, via the outer edge guide 32, until both the outer edge guide lies adjacent the projecting member, and the inner edge guide lies adjacent the roll. Thus, the roll can easily be loaded and centered in housing 12.

Whether the force applied to the outer edge guide 32 is conveyed to projecting member 30 or to the inner edge guide 28 depends on the width of roll 22 and the position of the inner edge guide when the roll is first placed on spindle 24. For example, when the projecting member 30 meets the outer edge guide 32 before the roll 22 is adjacent the inner edge guide 28, the outer edge guide will push the projecting member toward side wall 23, until the other end 22*b* of the roll meets the flange 28*a* of the inner edge guide as the inner edge guide moves away from side wall 23. However, if the roll 22 meets the inner edge guide 28 before the outer edge guide 32 meets the projecting member 30, the roll will push the inner edge guide toward side wall 23 as it is moved along the spindle, until the outer edge guide meets projecting member 30 as the projecting member moves away from side wall 23. In either case, the roll is automatically centered when the roll can no longer be pushed any farther into the housing. The opposing motion of the inner edge guide and the projecting member is achieved via the rack and pinion assembly 33 described earlier. Accordingly, rolls of different widths may automatically be centered in housing 12 while eliminating the possibility of a misaligned roll. In the preferred embodiment, rolls may vary from 1 to 4 inches in width between its ends 22*b* and 22*c* (FIG. 2).

Figure 4:
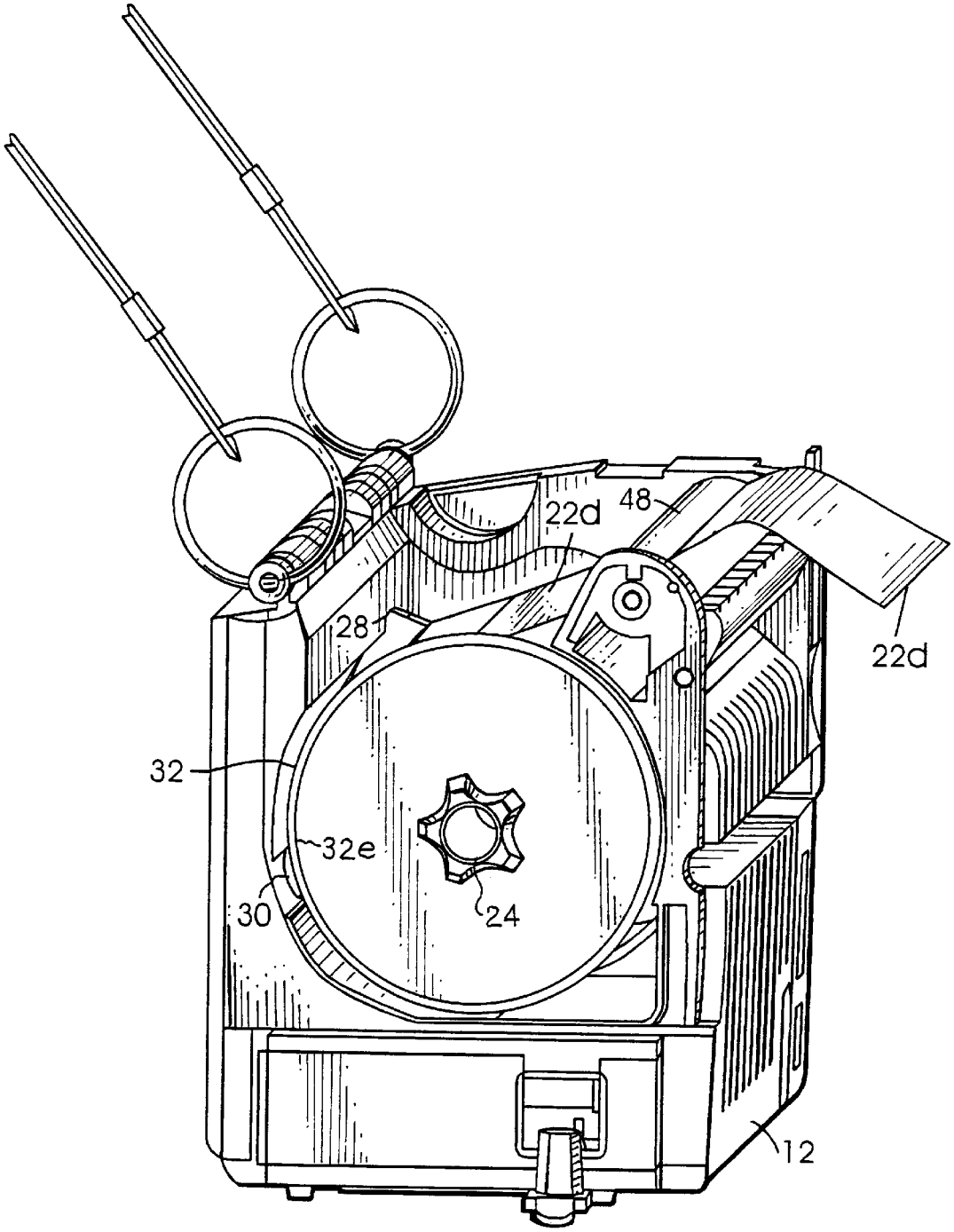
FIG. 4 is perspective view similar to FIG. 1 with a roll of stock loaded in the printer.

After centering roll 22, it is locked or held in place on spindle 24 by fingers 32*c* which are pressured against the inner surface of core 22*a* by the force of spindle 24 against the fingers. Tabs 32*d* on fingers 32*c* extend into the material of the core, if such material is compliant, to grip the core. Preferably, the outer diameter of spindle 24 is tapered toward opening 19 in cavity 20 to reduce the space between the spindle and the core as the outer edge guide 32 slides toward side wall 23 on the spindle, thereby pressuring the fingers 32*c* and tabs 32*d* outwards toward the core 22*a* of the roll. FIG. 4 is similar to FIG. 1 and shows roll 22 loaded and centered in housing 12. The roll is centered in the housing with respect to the position of pinion 39 in the housing. In other words, the roll is centered about the middle point of an imaginary line between the inner and outer edge guides 28 and 32, where the imaginary line is approximately parallel to the axis 26 of the spindle. In the figures, the middle point is aligned with the center of the pinion 39. However, the centered location of the roll along this imaginary line may be adjusted, such as by changing the location where the projecting member or inner edge guide is attached to their respective racks, or by moving the position of the pinion 39 in the housing.

After the roll is spent, its core 22*a* may be easily removed from housing 12. Generally, the operator can pull the outer edge guide 32 off spindle 24 and the core of the spent roll will be retained on the outer edge guide by fingers 32*c*. A new roll can then be loaded and automatically centered as described above.

The housing 12 of the printer has a platen roller 48 with a rubber surface which is rotatably mounted in bearings between side 18 and side wall 23. A motor (not shown) in the housing is coupled to one end of the platen 48 to drive the platen such that when the paper stock 22*d* from roll 22 is threaded around the platen the paper is pulled from roll as the roll freely rotates on spindle 24. A print head (not shown) is located in a hinged top cover 16*a* (FIG. 3), such that when cover 16*a* is closed in housing 12, the print head extends over a substantial length of the platen 48 and is centered in relation to the center position of the rack and pinion assembly 33. Thus, the center of the paper from rolls of different paper widths loaded in housing 12 will be identical with respect to the print head. The print head may be a thermal print head which is controlled to print indica on the paper as the paper is pulled by platen 48. Electronics is provided in the printer for controlling the operation of the print head and rotation of the platen 48, which may be responsive to switches 49 (FIG. 3). The motor and electronics are powered by a battery (not shown) in the housing. Straps 50 through rings 51 mounted to housing 12 may facilitate carrying of the printer by an operator, such as on a belt.

From the foregoing description, it will be apparent that there has been provided an improved mechanism for centering rolls of paper stock supplied for printing in a portable printer. Variations and modifications in the herein described system in accordance with the invention will undoubted suggest themselves to those skilled in the art. Accordingly, the foregoing description should be taken as illustrative and not in a limiting sense.

What is claimed is:

1. A mechanism for centering a roll of stock in a printer which prints upon the stock from said roll, said roll having a tubular core and two opposing ends, said printer having a housing with a cavity and an opening from a side thereof to provide a receptacle for said roll, said mechanism comprising:

a spindle disposed in said cavity towards said opening and mounted in said housing for rotation about an axis;

a pair of arms coupled to each other to move in opposite directions with respect to a center between said arms; and said arms being engagable with the opposing ends of said roll when received on said spindle for centering said roll on said spindle about said center.

2. The mechanism according to claim 1 wherein said arms are part of a rack and pinion assembly which moves said arms in opposite directions to each other.

3. The mechanism according to claim 1 wherein one of said pair of arms represents a first guide facing said first opposing end of said roll when in said cavity, and said other of said pair of arms represents a projecting member and a second guide adjacent to said projecting member and facing said second opposing end of said roll when in said cavity.

4. The mechanism according to claim 3 further comprising a first rack member coupled to said first guide to be moveable therewith, a second rack member coupled to said projecting member to be moveable therewith, and a pinion engagable with said first and second rack members to move said first and second rack members in opposite directions to each other.

5. The mechanism according to claim 4 further comprising two slots in said housing in which said first and second rack members, respectively, slide, and said pinion being rotatably mounted in said housing between said slots to engage teeth on said first and second rack members to move said members in said slots.

6. The mechanism according to claim 4 wherein said first guide and projecting member each have a window in said housing through which said first guide and said projecting member are attached to their respective rack members.

7. The mechanism according to claim 4 wherein said second guide applies a force against said roll as it is received on said spindle to move said first and second racks in opposite directions to each other by said force being conveyed against said first guide, via said roll, or said projecting member, via said second guide, until both said second guide lies adjacent said projecting member and said first guide lies adjacent to said roll.

8. The mechanism according to claim 3 wherein said second guide comprises a hub slidable along said spindle, and a flange extending from said hub which lies adjacent said projecting member when said roll is loaded on said spindle.

9. The mechanism according to claim 8 wherein said hub has fingers extending between said spindle and the core of said roll to lock said roll on said spindle when centered on said spindle.

10. The mechanism according to claim 8 wherein said flange is circular with a diameter larger than the diameter of the roll, and said projecting member engages the outer circumferential end of said flange.

11. The mechanism according to claim 3 wherein said first guide comprises a flange facing said roll when said roll is received on said spindle.

12. The mechanism according to claim 1 wherein said spindle is tapered along its length.

13. The mechanism according to claim 1 wherein said arms move in said opposite directions parallel to said axis.

14. The mechanism according to claim 1 wherein said arms move in opposite directions to each other responsive to an external force applied to one of said arms.

15. The mechanism according to claim 14 wherein said external force is applied by an operator to one of the arms when said roll is received on said spindle.

16. A method for centering a roll of stock in a printer, said printer having a housing with a cavity and an opening from a side thereof to provide a receptacle for said roll, a spindle disposed in said cavity toward said opening, and a pair of arms which are coupled to each other to move in opposite directions with respect to a center between said arms, said method comprising the steps of:

placing said roll onto said spindle;

pushing said roll along said spindle to operate said pair of arms to move in opposite directions with respect to said center; and centering said roll about said center between said arms as said pushing step is carried out.

17. The method according to claim 16 wherein said arms are part of a rack and pinion assembly which moves said arms in opposite directions to each other.

18. The method according to claim 16 further comprising the steps of:

positioning part of one of said arms onto said spindle with said roll.

19. The method according to claim 16 wherein said pushing step is carried out by pushing at least one of said arms.

* * * * *